US010866028B2

(12) United States Patent
Ewert et al.

(10) Patent No.: US 10,866,028 B2
(45) Date of Patent: Dec. 15, 2020

(54) TELEMATICS SYSTEM FOR ROTARY VACUUM DRUM DRYING SYSTEM

(71) Applicant: Anderson Industries, LLC, Webster, SD (US)

(72) Inventors: Daniel Ewert, Lake Park, MN (US); Joel Jorgenson, Fargo, ND (US)

(73) Assignee: Anderson Industries, LLC, Webster, ND (US)

( * ) Notice: Subject to any disclaimer, the term of this patent is extended or adjusted under 35 U.S.C. 154(b) by 168 days.

(21) Appl. No.: 16/182,001

(22) Filed: Nov. 6, 2018

(65) Prior Publication Data

US 2019/0137179 A1 May 9, 2019

Related U.S. Application Data

(60) Provisional application No. 62/583,304, filed on Nov. 8, 2017.

(51) Int. Cl.
*F26B 13/30* (2006.01)
*F26B 11/04* (2006.01)
(Continued)

(52) U.S. Cl.
CPC ..... *F26B 11/049* (2013.01); *F26B 5/041* (2013.01); *F26B 5/12* (2013.01); *F26B 17/282* (2013.01);
(Continued)

(58) Field of Classification Search
CPC ..... F26B 11/049; F26B 5/12; F26B 5/041; F26B 25/04; F26B 25/20; F26B 25/22;
(Continued)

(56) References Cited

U.S. PATENT DOCUMENTS 5,806,204 A * 9/1998 Hoffman ..... D06F 58/24 34/92
8,196,242 B2 6/2012 Kim et al.
(Continued)

FOREIGN PATENT DOCUMENTS

SU 521909 A1 * 7/1976
SU 521909 9/1976
SU 860825 9/1981

OTHER PUBLICATIONS

International Search Report and Written Opinion dated Feb. 14, 2019 for International application No. PCT/US2018/059622.
(Continued)

*Primary Examiner* — John P McCormack
(74) *Attorney, Agent, or Firm* — Womble Bond Dickinson (US) LLP

(57) ABSTRACT

A rotary vacuum drum drying system is described. The system may include a plurality of sensors and a control system operatively coupled with the plurality of sensors. The control system includes a processing device to receive, from the plurality of sensors, a plurality of parameters of the rotary vacuum drum drying system and transmit, to a client device, the plurality of parameters of the rotary vacuum drum drying system. The processing device is further to receive, from the client device, a message comprising an adjustment one or more parameters of the plurality of parameters and adjust the one or more parameters of the plurality of parameters based on the received message.

4 Claims, 7 Drawing Sheets

(51) Int. Cl.

| | |
|---|---|
| ***F26B 5/04*** | (2006.01) |
| ***F26B 25/12*** | (2006.01) |
| ***F26B 25/00*** | (2006.01) |
| ***F26B 5/12*** | (2006.01) |
| ***F26B 25/04*** | (2006.01) |
| ***F26B 17/28*** | (2006.01) |
| ***F26B 25/20*** | (2006.01) |
| ***F26B 25/22*** | (2006.01) |

(52) U.S. Cl.
CPC ..... *F26B 17/288* (2013.01); *F26B 25/001* (2013.01); *F26B 25/008* (2013.01); *F26B 25/04* (2013.01); *F26B 25/12* (2013.01); *F26B 25/20* (2013.01); *F26B 25/22* (2013.01)

(58) Field of Classification Search
CPC ..... F26B 25/12; F26B 25/008; F26B 25/001; F26B 17/288; F26B 17/282
USPC ..... 34/92, 402, 108
See application file for complete search history.

(56) References Cited

U.S. PATENT DOCUMENTS

| | | | | |
|---|---|---|---|---|
| 2010/0272460 | A1* | 10/2010 | Zona | G03G 21/0011 399/71 |
| 2012/0285867 | A1* | 11/2012 | Schmidt | B01D 33/463 208/390 |
| 2014/0208606 | A1* | 7/2014 | Mathis, Jr. | F26B 3/0923 34/164 |
| 2017/0067229 | A1* | 3/2017 | Stock | E02F 9/2054 |
| 2019/0045818 | A1* | 2/2019 | Born | B01D 1/225 |
| 2020/0157761 | A1* | 5/2020 | Park | H02J 50/12 |

OTHER PUBLICATIONS

Transmittal of International Preliminary Report on Patentability for PCT/US2018/059622, filed Nov. 7, 2018, dated May 22, 2020, 7 pages.

* cited by examiner

TELEMATICS SYSTEM FOR ROTARY VACUUM DRUM DRYING SYSTEM

CROSS REFERENCE TO RELATED APPLICATIONS

This application claims the benefit of U.S. Provisional Patent Application No. 62/583,304, filed on Nov. 8, 2017, which is hereby incorporated by reference in its entirety.

TECHNICAL FIELD

Aspects and implementations of the present disclosure relate to vacuum drying systems.

BACKGROUND

Rotary vacuum drum dryers were originally developed as a means to separate solids from a slurry. Vacuum drum dryers are one of the first industrial systems created to separate solids from liquids, and are prevalent in diverse industries from food production, wine and distilled spirits production, and the production of various materials for the construction sector. In basic vacuum drum dryers, the level of the slurry tank with respect to the rotating drum and the rotational speed of the drum are the two parameters most commonly used to make performance adjustments.

BRIEF DESCRIPTION OF THE DRAWINGS

Embodiments and implementations of the present disclosure will be understood more fully from the detailed description given below and from the accompanying drawings of various aspects and implementations of the disclosure, which, however, should not be taken to limit the disclosure to the specific embodiments or implementations, but are for explanation and understanding only.

DETAILED DESCRIPTION

Aspects and implementations of the present disclosure are directed to an apparatus for and method of controlling a rotary vacuum drum drying system. In one embodiment, the rotary vacuum drum drying system includes a plurality of sensors and a control system operatively coupled with the plurality of sensors. The control system includes a processing device configured to monitor the plurality of parameters of the vacuum drying system received from the plurality of sensors. The control system further includes a telematics component to transmit the plurality of parameters to a client device via a network. In embodiments, upon receipt of the plurality of parameters, the client device receives an input corresponding to an adjustment that is to be made to one or more of the plurality of parameters. The client device transmits a message via the network to the control system of the vacuum drying system that includes the adjustment to the one or more of the plurality of parameters. Upon receipt of the message, the control system adjusts the one or more parameters based on the received message.

In conventional vacuum drying systems, the lack of instrumentation prevents a refined means to control, monitor, or predict the performance of a rotary vacuum drum dryer. Furthermore, many conventional vacuum drying systems may be located in remote areas that are far from skilled technicians that may be able to identify issues with the vacuum drying system (e.g., malfunctioning parts, predictive maintenance, etc.) and make adjustments to improve the performance of the vacuum dryer system. This lack of access to skilled technicians can lead to inefficient operation of the vacuum dryer and/or an increase in the malfunctions and downtime of the vacuum dryer system.

Embodiments of the present disclosure describe a control system including a telematics component that monitors multiple parameters of the vacuum drying system and provides the multiple parameters to a client device. The control system may include remote monitors, sensors, and switches coupled to a display system. The control system may include a transmitter (wired and/or wireless) to transmit the parameters monitored by the control system to a client device via a network. The client device may be a device associated with a technician of the vacuum dryer system and may allow the technician to adjust the parameters of the control system of the vacuum dryer system. The client device may transmit a message that includes the adjustments to the parameters to the control system of the rotary vacuum drum dryer system. Upon receipt of the message, the control system may adjust the parameters of the rotary vacuum drum dryer system based on the adjustments included in the received message. The ability to transmit the parameters of the vacuum dryer system to a client device and receive adjustments to parameters of the vacuum dryer system allows for optimal design for performance, throughput, and system longevity.

Figure 1:
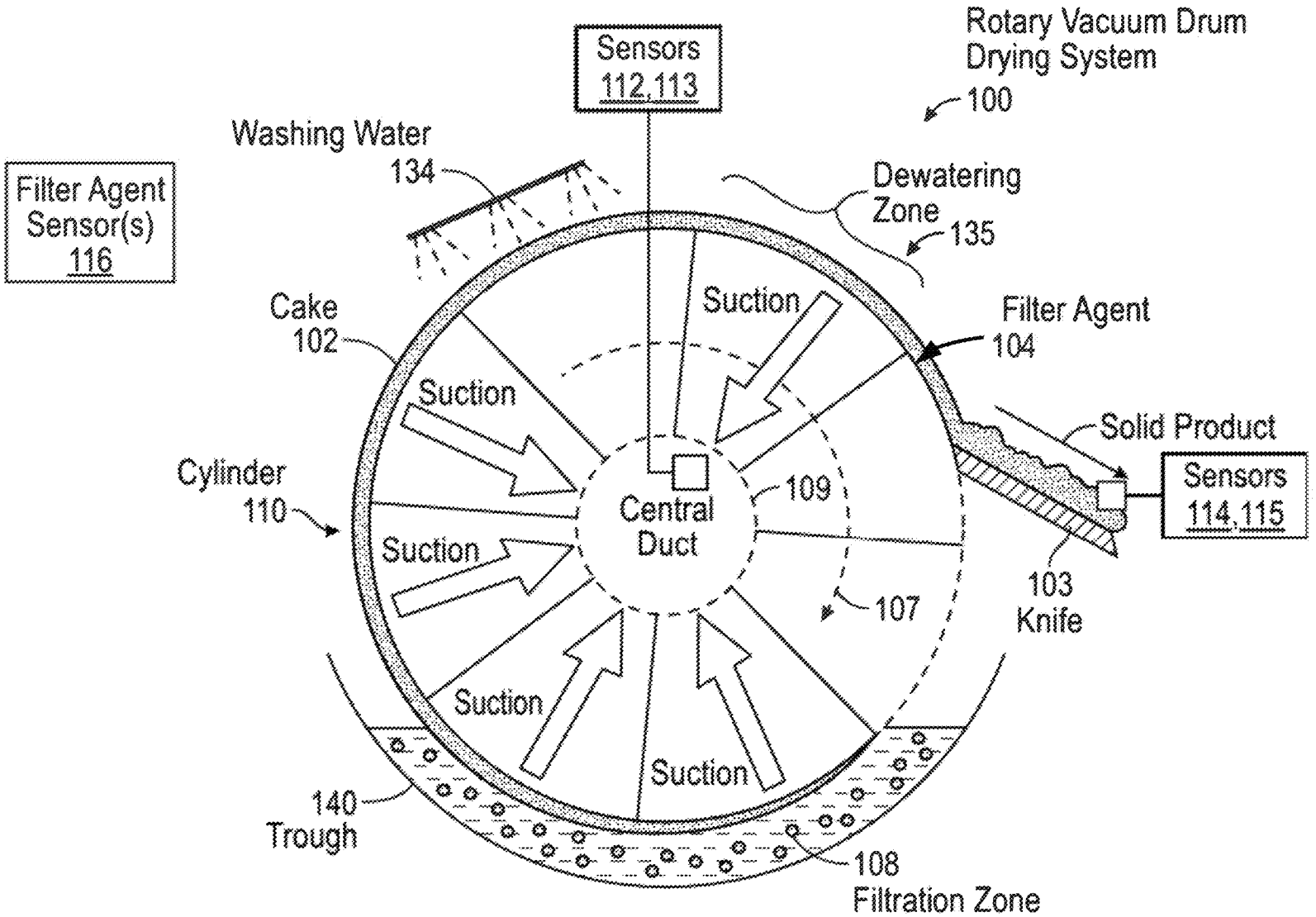
FIG. 1 is a cross section of a rotary vacuum drum drying system in accordance with one embodiment of the present disclosure.

FIG. 1 is a cross section of a rotary vacuum drum drying system in accordance with one embodiment of the present disclosure. In this embodiment, rotary vacuum drum drying system 100 includes a central component composed of a perforated cylinder 110 covered with a breathable membrane cover, with a removable filter agent 104 coating. The cylinder 110 rotates 107 along its transverse axis, with a trough 140 containing a slurry mixture that immerses the lower region of the cylinder.

The portion of the cylinder 110 immersed in the slurry mixture may be defined as a filtration zone 108. By comparison, the portion of the cylinder not immersed in the slurry mixture may be defined as the drying zone. If a water rinse 134 is added to the process of vacuum drum drying, the section of drum immediately past the water rinse may be defined as a dewatering zone 135.

As the cylinder 110 rotates 107, a vacuum is applied near the point of rotation in central duct 109, suctioning the slurried material (also referred to as "cake") 102 on the surface of the cylinder towards the interior of the drum. Air passes through perforations in the surface of the cylinder 110, solids from the slurried material 102 gathers on the filter agent 104. As the cylinder drum 110 rotates, the continued vacuum pressure pulls moisture from the filter agent 104. In certain embodiments, a water rinse 134 is applied to the exterior of the vacuum drum, where the re-wetting of the slurry provides operational benefit for the drying. In one embodiment, at a point of approximately 270 degrees of rotation, a knife or blade 103 scrapes the outside layer of filter agent 104 from the rotating drum cylinder 110 to generate solid product. Alternatively, other scraping of filter agent 104 may be performed at other degrees of rotation of the cylinder. The solid product is then transported from the system.

Figure 2:
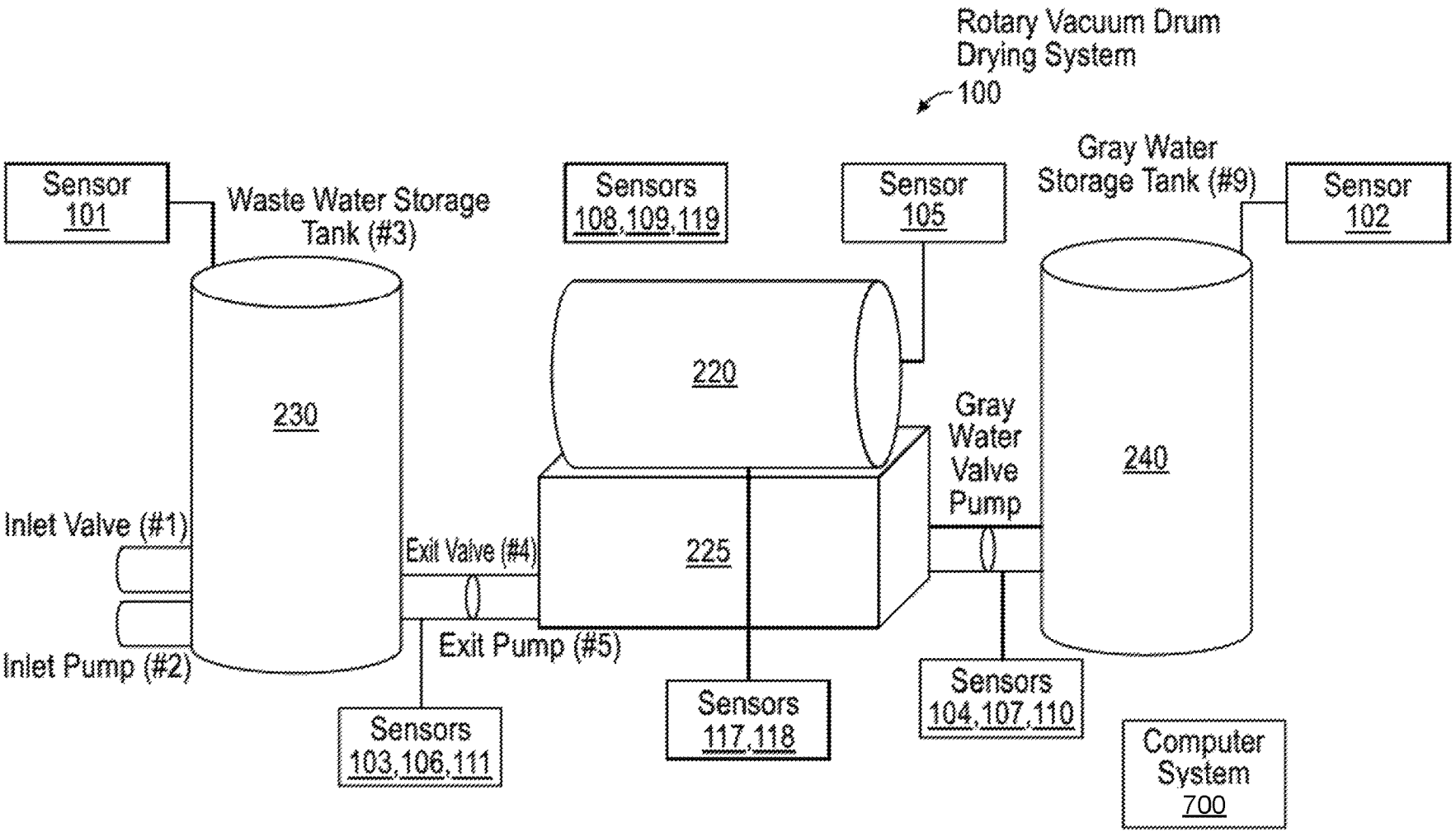
FIG. 2 illustrates a configuration of the vacuum drum dryer surrounded by other system components the system such as tanks and pumps that may be connected to the control system in accordance with one embodiment of the present disclosure.

In an instrumented system for separating solids from a slurry mixture, the slurry mixture is initially stored in a waste water tank 230 of FIG. 2. The slurry mixture from the slurry tank 230 is pumped into the trough of the vacuum drum dryer for separation into solid and liquid components. The recovered liquids extracted by the drum drying process are stored in a gray water tank 240 of FIG. 2, with the quality of the recovered liquid measured by sensors in the connection between the vacuum drum dryer and the gray water tank.

Embodiments of the present disclosure describe an electronic control and monitoring system for the rotary vacuum drum drying system. Using advanced sensing, data analytics, processing and communications, the control system allows any time access from any location globally. The control system may be reprogrammed via a telematics system, providing the capability for a remote technical staff to monitor sensors, insert test code, make measurements, and update the programming on any machine worldwide.

The electronic control and monitoring system may be composed of a number of sensors and other components described below to monitor parameters of the rotary vacuum drum drying system. In one embodiment, the rotary vacuum drum drying system 100 includes one or more filter agent sensors 116 to monitor the quantity of unused filter agent (on the drum and/or on reserve). The system may also include a rotational speed sensor 112 for measuring the speed of rotation of the vacuum drum cylinder 110 and vacuum pressure sensor 113 for measuring the vacuum pressure of the system discussed above. In some embodiments, the system may also include a moisture sensor 114 to monitor the moisture content of the removed filter agent 104 and a mass sensor 115 to monitor the mass or rate of mass of the removed filter agent 104. It should be noted that the various sensors are conceptually illustrated in the figures and are not necessarily physically disposed in the locations at which they are shown. For example, sensors 112 and 113 are not necessarily physically disposed within the central duct 109 but, rather, may reside outside the central duct and may also reside beyond the surface of cylinder 110. It should be noted that in one embodiment, the control system may combine both measured parameters (e.g., rotational speed) and derived parameters (e.g., mass of removed material per watt of electrical energy used by the vacuum pump).

FIG. 2 illustrates a configuration with the vacuum drum dryer 220 surrounded by other system components such as tanks and pumps that may be connected to the control system that includes a telematics component. In this embodiment, the rotary vacuum drum drying system includes vacuum drum dryer 220, wastewater storage tank 230, and gray water storage tank 240.

Integrating system information with a control system having telematics functionality allows for greater throughput, efficiencies, and cost savings. For example, information regarding the level of the wastewater storage tank 230 is important to know to ensure that vacuum drum dryer 220 continues to receive waste water and prevent unnecessary shearing of filter agent. Also, ensuring that the outflow to the clean water outlet, pump, and tank is working prevents backflow into the vacuum drum dryer 220 that could damage systems and cause potentially costly and dangerous system failures.

In some embodiments, the control system may also include other sensors to monitor other parameters of rotary vacuum drum drying system 100. For example, the system may also include sensors 101 and 102 to monitor levels of inlet and outlet fluids in tanks 230 and 240, respectively. The system may also include sensors 103, 104 to monitor flow rates of inlet and outlet fluids to vacuum drum dryer 220, electrical sensors 106, 107 on the power consumed by inlet and outlet pumps, sensor 111 to monitor the solid content of the inlet fluid to vacuum drum dryer 220, and sensor 110 to monitor the clarity of outlet fluid to tank 240. The system may also include a sensor 105 to monitor the electrical power consumption of motors (not illustrated) inside housing base 225 driving vacuum drum dryer 220. The system may also include a sensor 109 for monitoring the ambient humidity levels of the environment in which the vacuum drum dryer 220 is operating. The system may also include sensors 117 and 119 for monitoring the Machine vibration and temperatures (used for diagnostics and machine health analysis) of the vacuum drum dryer 220. The system may also include an external sensor 119 to monitor the time of day and calendar day.

The monitored parameters noted above may be used to identify issues, recommend preventative maintenance and/or optimize the efficiency of the wastewater treatment process. For example, the rotary vacuum drum drying system may be optimized for at least one of throughput of water, drying agent removal, or water removal. Optimizing for the throughput of water might include high rates of vacuum and high rotational rates for the vacuum drum. Optimizing for drying agent removal might be composed of low rates of vacuum and low rates of rotation. Optimizing for water removal might consist of high rates of vacuum and low rates of rotation. These optimization operations may or may not be the same as the settings used to optimize the individual operation of the vacuum drum dryer. In embodiments, the material blade extraction position may be adjusted to reduce the amount of filer material lost per revolution, thereby reducing the frequency that the filter needs to be re-applied to the vacuum drum. To optimize water extraction rates, the level of wastewater in storage tank 230 can be maintained to ensure that the rotary vacuum drum drying system continues to receive wastewater and prevent over-shearing of a filter agent. Over-shearing may be prevented by controlling the outflow of storage tank 230 to prevent backflow into the vacuum drum. The control system composed of a processing device 702 receives information from the sensors about system 100 status and performance.

The control system may transmit the received information from the sensors about system 100 status and performance using the telematics system to a client device, as described in further detail below. In embodiments, the control system may monitor the sensors and use control algorithms to optimize the operation for variations in environmental conditions, such as air temperature, relative humidity, etc. and slurry conditions such as temperature, percent solids, etc. In embodiments, the control system may implement one or more alarms to signal when a particular parameter of the system 100 is above or below a threshold value.

Figure 3:
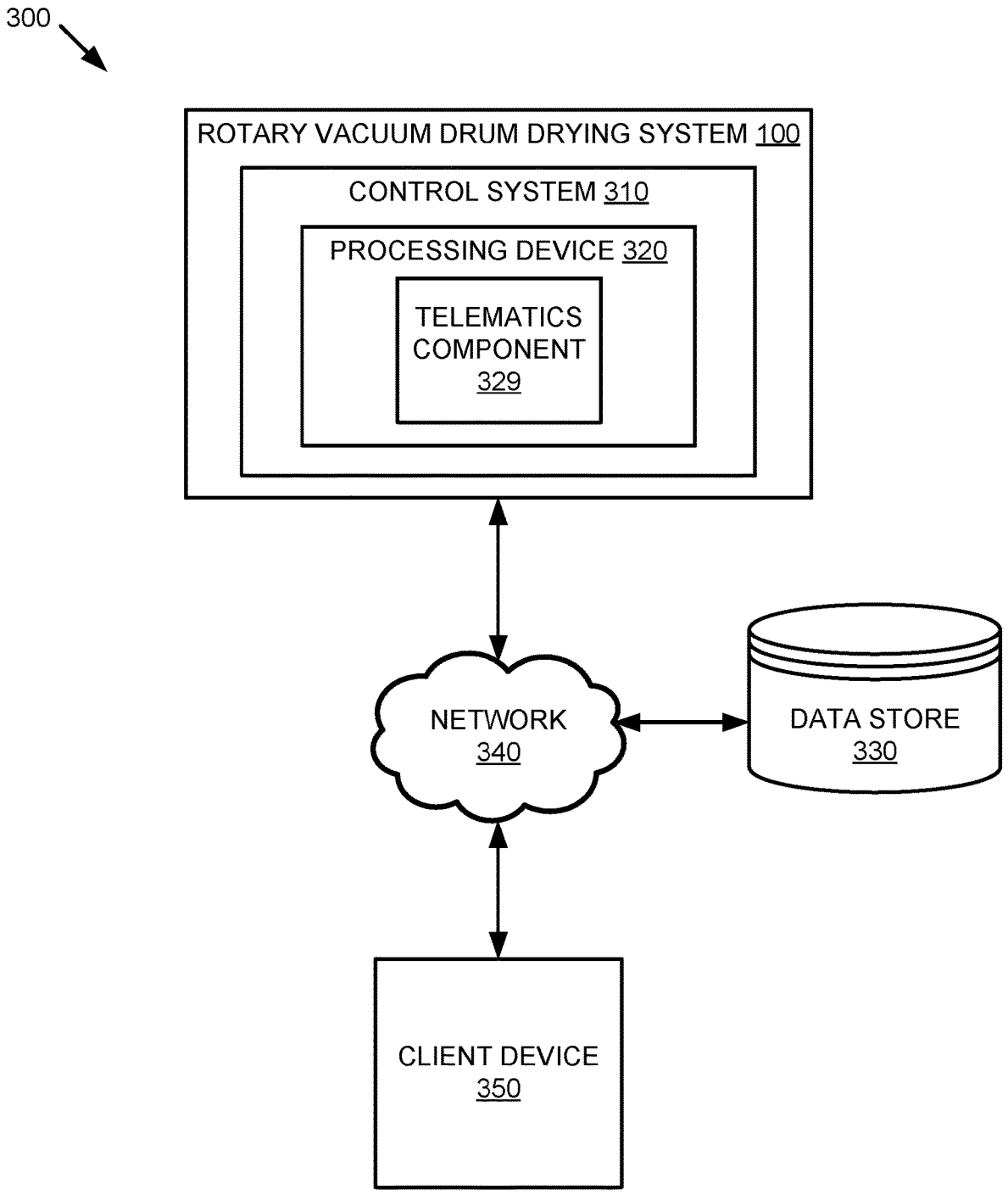
FIG. 3 is a block diagram that illustrates an example of a telematics system in accordance with an embodiment of the present disclosure.

FIG. 3 is a block diagram that illustrates an example of a telematics system 300, in accordance with an embodiment of the present disclosure. The telematics system 300 may include a control system 310 of a rotary vacuum drum dryer system 100, as previously described with respect to FIGS. 1 and 2. In embodiments, the rotary vacuum drum dryer system 100 may be located within a waste water treatment plant, as previously described at FIG. 2. The control system 310 includes a processing device 320 that executes a telematics component 329. In embodiments, the control system 310 may be operatively coupled to a data store 330 and a client device 350 via a network 340. In some embodiments, the data store 330 may reside in the control system 310.

The network 340 may be a public network (e.g., the internet), a private network (e.g., a local area network (LAN) or wide area network (WAN)), or a combination thereof. In one embodiment, network 340 may include a wired or a wireless infrastructure, which may be provided by one or more wireless communications systems, such as a wireless fidelity (WiFi) hotspot connected with the network 340 and/or a wireless carrier system that can be implemented using various data processing equipment, communication towers (e.g. cell towers), etc.

The client device 350 may be a computing device, such as a personal computer, laptop, cellular phone, personal digital assistant (PDA), gaming console, tablet, etc. In embodiments, the client device 350 may be associated with a technician for the rotary vacuum drum dryer system 100.

The data store 330 may be a persistent storage that is capable of storing data (e.g., parameters associated with a rotary vacuum drum drying system 100, as described herein). A persistent storage may be a local storage unit or a remote storage unit. Persistent storage may be a magnetic storage unit, optical storage unit, solid state storage unit, electronic storage units (main memory), or similar storage unit. Persistent storage may also be a monolithic/single device or a distributed set of devices.

In embodiments, data store 330 may be a central server or a cloud-based storage system including a processing device (not shown). The central server or the cloud-based storage system may be accessed by control system 310 and/or client device 350. Parameters from the rotary vacuum drum drying system 100 may be transmitted to the data store 330 for storage. In embodiments, upon receipt of the parameters, the data store 330 may transmit the parameters to client device 350. In some embodiments, the parameters stored at the data store may be accessed by client device 350 via a user interface. For example, the data store 330 may generate a graphical user interface (GUI) to present the parameters of the rotary vacuum drum drying system 100 to client device 350. In embodiments, client device 350 may provide adjustments to one or more parameters of the rotary drum drying system 100 to the data store 330. In some embodiments, upon receipt of the adjustments, the data store 330 may transmit the adjustments to the parameters to control system 310. In some embodiments, the adjustments to the parameters may be accessed by control system 310 via a user interface.

In embodiments, telematics component 329 may transmit parameters of a vacuum dryer system to client device 350. Telematics component 329 may receive, from client device 350, a message that includes one or more adjustments to one or more parameters of the vacuum dryer system. Aspects of telematics component 329 will be discussed in further detail below.

Figure 4:
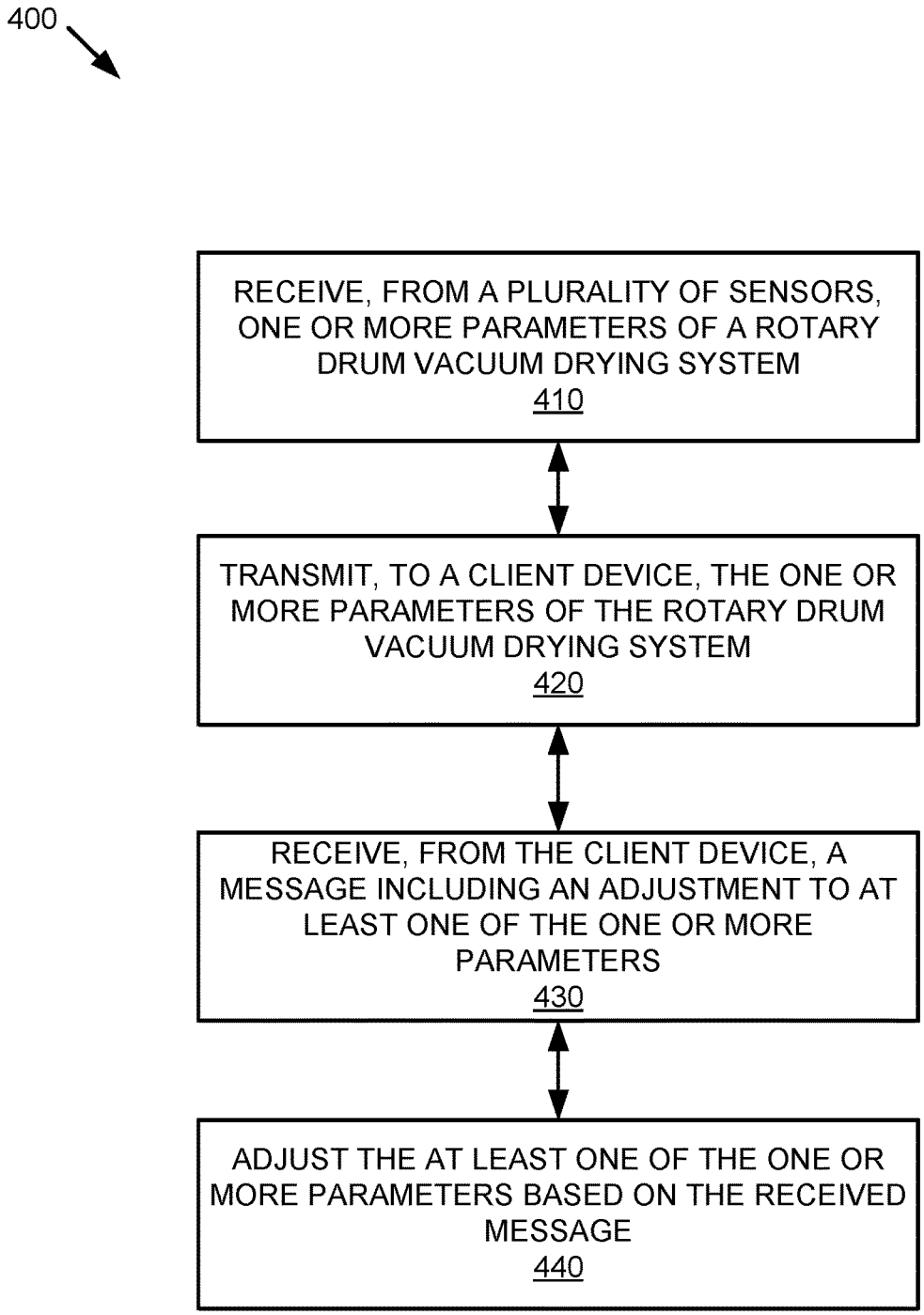
FIG. 4 depicts a flow diagram of a method for controlling a vacuum drying system in accordance with one implementation of the present disclosure.

FIG. 4 depicts a flow diagram of a method 400 for controlling a vacuum drying system in accordance with one implementation of the present disclosure. In embodiments, various portions of method 400 may be performed by telematics component 329 of FIG. 3.

With reference to FIG. 4, method 400 illustrates example functions used by various embodiments. Although specific function blocks ("blocks") are disclosed in method 400, such blocks are examples. That is, embodiments are well suited to performing various other blocks or variations of the blocks recited in method 400. It is appreciated that the blocks in method 400 may be performed in an order different than presented, and that not all of the blocks in method 400 may be performed.

At block 410, data sent by one or more sensors of rotary vacuum drum drying system described above on one or more parameters of the system is received by a control system (e.g., processing device 702). In embodiments, upon receipt of the data from the one or more sensors, the control system may perform analysis on the received data. In an embodiment, the control system may analyze the data to determine whether any of the one or more parameters satisfies a threshold. In embodiments, a parameter may satisfy a threshold if the parameter is greater than or equal to the threshold. In other embodiments, the parameter may satisfy the threshold if the parameter is less than or equal to the threshold. For example, if the speed of rotation of the vacuum drum is greater than a threshold, then the control system may determine that the speed of rotation satisfies the threshold.

In embodiments, the control system may analyze the data to determine whether a component of the rotary vacuum drum drying system is to be replaced. For example, if the speed of rotation of the vacuum drum is lower than an expected value, the control system may determine that a motor driving the speed of rotation is to be replaced. In some embodiments, the control system may analyze the data to determine whether one or more components of the rotary vacuum drum drying system have experienced a failure. For example, if the level of waste water in a waste water storage tank drops below a particular level, then the control system may determine that an inlet valve to the waste water storage tank has experienced a failure.

At block 420, the control system transmits the one or more parameters to a client device. The control system may transmit the one or more parameters to a client device via a network (e.g., network 340 of FIG. 3).

In embodiments, the control system may identify a client device associated with the rotary vacuum drum drying system in a data structure stored at data store 330. For example, the control system may identify one or more client devices associated with technicians for the rotary vacuum drum drying system and transmit the one or more parameters to the identified client devices. In some embodiments, the control system may generate a user interface that includes information associated with the one or more parameters to be presented on the client device. For example, the control system may generate a graphical user interface (GUI) to be presented in a display of the client device. In embodiments, a copy of the transmitted parameters may be stored at data store 330 for subsequent analysis or to identify trends in the parameters over a period of time. For example, a particular parameter decreasing over a period of time may indicate that a component of the rotary vacuum drum drying system is likely to fail and needs to be replaced or preventative maintenance needs to be performed.

At block 430, the control system receives a message including an adjustment to at least one of the one or more parameters. For example, the message may include an adjustment to decrease the speed of rotation of the vacuum drum of the rotary vacuum drum drying system to a particular value. At block 440, the control system adjusts the at least one of the one or more parameters based on the message received at block 430. For example, upon receiving a message from the client device that includes an adjustment to decrease the speed of rotation of the vacuum drum to a particular value, the control system may decrease the speed of rotation of the vacuum drum to the particular value included in the received message.

Figure 5:
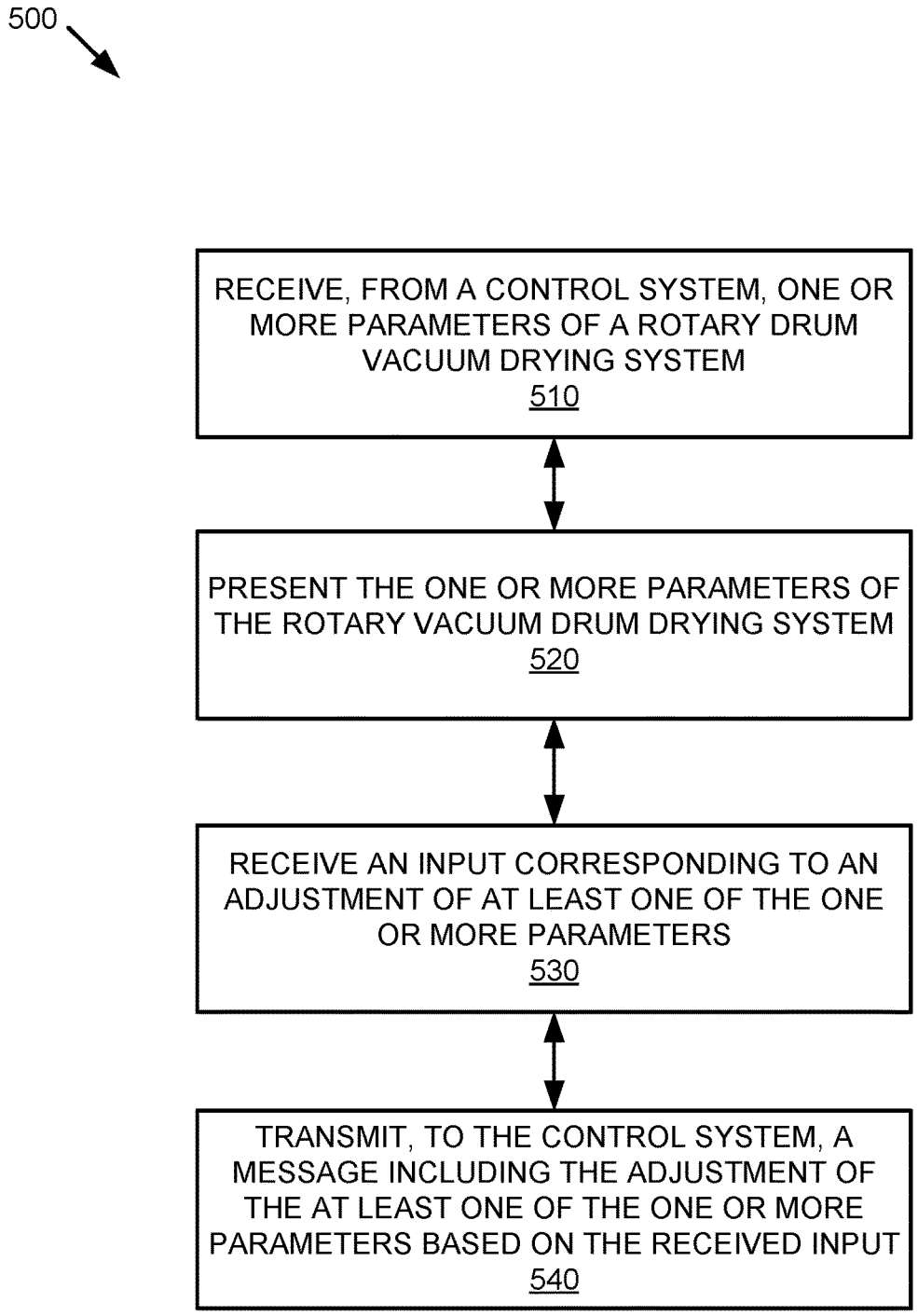
FIG. 5 depicts a flow diagram of a method for adjusting parameters of a vacuum drying system by a client device in accordance with one implementation of the present disclosure.

FIG. 5 depicts a flow diagram of a method 500 for adjusting parameters of a vacuum drying system by a client device in accordance with one implementation of the present disclosure. In embodiments, various portions of method 500 may be performed by client device 350 of FIG. 5.

With reference to FIG. 5, method 500 illustrates example functions used by various embodiments. Although specific function blocks ("blocks") are disclosed in method 500, such blocks are examples. That is, embodiments are well suited to performing various other blocks or variations of the blocks recited in method 500. It is appreciated that the blocks in method 500 may be performed in an order different than presented, and that not all of the blocks in method 500 may be performed.

At block 510, the client device receives, from a control system of a rotary vacuum drum drying system, one or more parameters of the rotary vacuum drum drying system as previously described. In embodiments, the one or more received parameters may include a user interface for presentation on a display of the client device. At block 520, the client device presents the one or more parameters of the rotary vacuum drum drying system. In some embodiments, the client device may present a user interface received from the control system on a display of the client device. In other embodiments, upon receipt of the one or more parameters, the client device may generate a user interface for presenting information associated with the one or more parameters on a display of the client device. In embodiments, the user interface may include one or more selectable icons or fields to receive inputs from a user of the client device. For example, the user interface may include selectable icons to increase or decrease a parameter or a text field that allows a user of the client device to input a particular value for a parameter.

At block 530, the client device receives an input corresponding to an adjustment of at least one of the one or more parameters. For example, the client device may receive an input that corresponds to adjusting the speed of rotation of the vacuum drum of the rotary vacuum drum drying system. In embodiments, the client device may receive an input via a user interface presented on the display of the client device, as previously described. At block 540, the client device transmits a message including the adjustment of the at least one of the one or more parameters to the control system based on the input received at block 530. In embodiments, the message may cause the control system of the rotary vacuum drum drying system to adjust the one or more parameters of the rotary vacuum drum drying system.

In some embodiments, the message transmitted to the control system may include an indication to perform one or more actions with respect to the rotary vacuum drum drying system. For example, the message may include a message that maintenance needs to be performed or a component needs to be replaced. In embodiments, the message including the indication may be transmitted to a client device associated with a local technician that services the rotary vacuum drum drying system.

Figure 6:
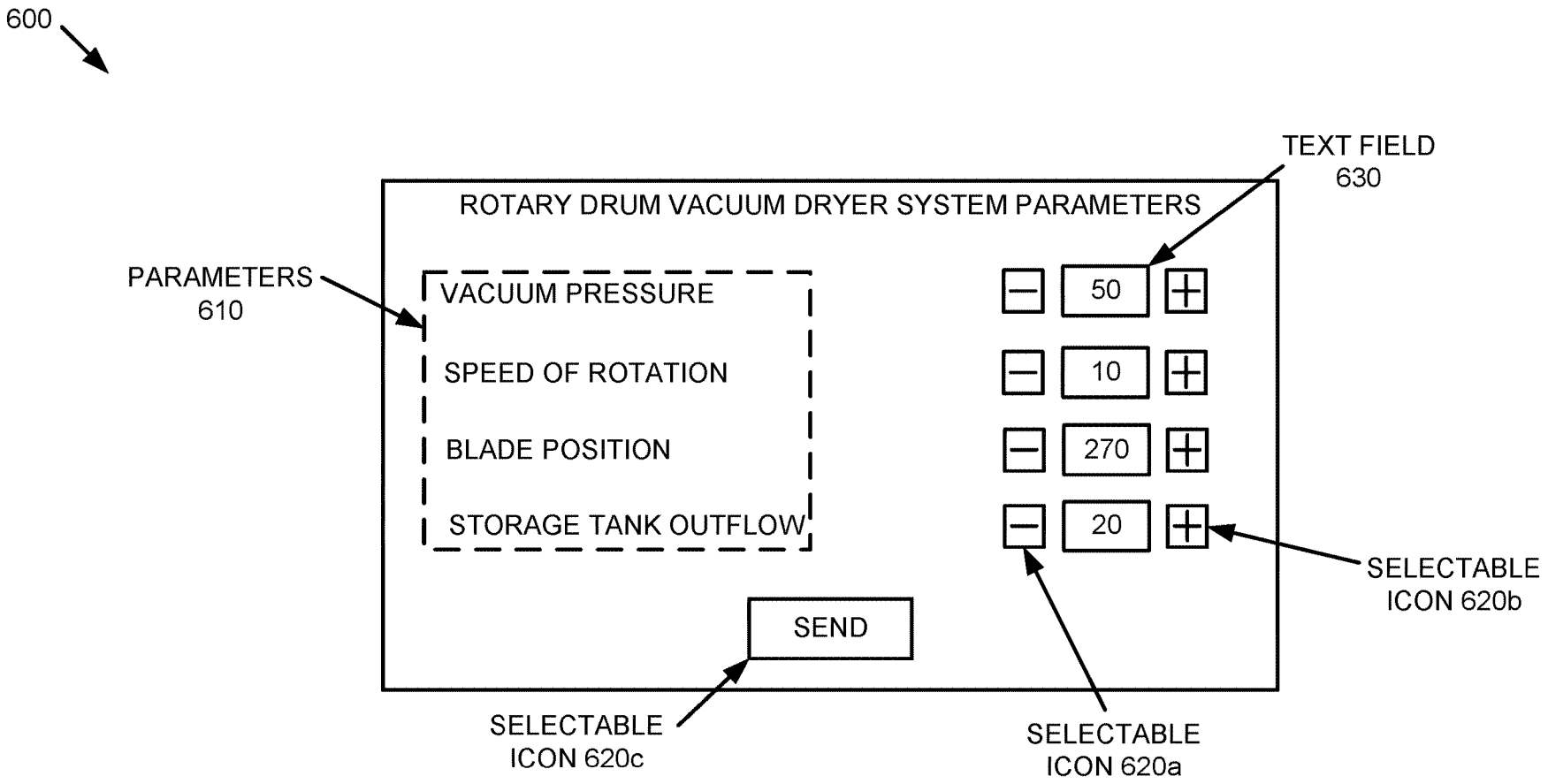
FIG. 6 is an illustration of an example of a user interface to present one or more parameters of a rotary vacuum drum drying system in accordance with embodiments of the disclosure.

FIG. 6 is an illustration of an example of a user interface 600 to present one or more parameters of a rotary vacuum drum drying system in accordance with embodiments of the disclosure. As previously described, in some embodiments a user interface may be generated to present the parameters of a rotary vacuum drum drying system. In embodiments, the user interface 600 may be generated by control system 310. In an embodiment, the user interface 600 may be generated by data store 330. In some embodiments, the user interface 600 may be generated by client device 350.

The user interface 600 may include information associated with one or more parameters 610 of the rotary vacuum drum drying system. Referring to FIG. 6, the parameters 610 presented in the user interface 600 correspond to the vacuum pressure, speed of rotation, blade position and storage tank outflow of a rotary vacuum drum drying system. It should be noted that the parameters 610 included in user interface 600 are for illustrative purposes only and embodiments of the disclosure may display any combination of parameters of a rotary vacuum drum drying system.

Each of parameters 610 may include a corresponding text field 630. Values presented in text fields 630 may correspond to the received parameters from the rotary vacuum drum drying system. In embodiments, text fields 630 may be selected and an adjustment to the parameter may be entered into the text field 630. For example, a technician may select text field 630 that corresponds to the vacuum pressure and enter an adjustment to adjust the vacuum pressure from 50 to 45.

User interface 600 may also include selectable icons 620*a*, 620*b* and 620*c*. Selectable icons 620*a*, 620*b* and 620*c* may be selected by a control system and/or client device to perform a desired action. For example, selectable icon 620*a* may decrease the value of a corresponding parameter when selected. Selectable icon 620*b* may increase the value of the corresponding parameter when selected. In embodiments, selectable icon 620*c* may transmit (e.g., send) a message including adjustments to be made to the parameters of the rotary drum vacuum dryer system.

Embodiments of the vacuum drum dryer described herein accomplish different results than conventional vacuum drum dryers. The efficiencies of the vacuum drum dryer with the electronics, as measured by output product (removed solid mass and extracted liquid) will be greater than a conventional system, as the drying parameters may be monitored and/or adjusted remotely via a client device. Furthermore, adjustments may be made more quickly and more frequently since a technician is not required to travel to the physical location of the rotary vacuum drum dryer system to manually make adjustments. For example, operating a drum dryer on a warm, arid day requires less vacuum pressure and less drying time, allowing the rotational speed of the vacuum drum dryer to be increased and the pressure created by the vacuum pump to be reduced. Additionally, the quality of the product produced (again measured in the removed solid mass and the extracted liquid) when using the control system including the telematics component will be greater than a conventional system, as the parametric values of the outputs may be transmitted to a client device and analyzed for consistency. As these examples show, the quality and the efficiency of the vacuum drum dryer when using a control system including a telematics component are increased to levels unattainable through conventional operation.

The end user may adjust all settings via the wired and wireless communications channels (e.g., cellular, satellite, and/or local connectivity such as Bluetooth™, Zigbee™, or WiFi™) using components of computer system 700. The choice of communication channels ensure the potential to connect from any platform at any time, and may be selected based on power consumption, channel capacity, noise, and security.

Figure 7:
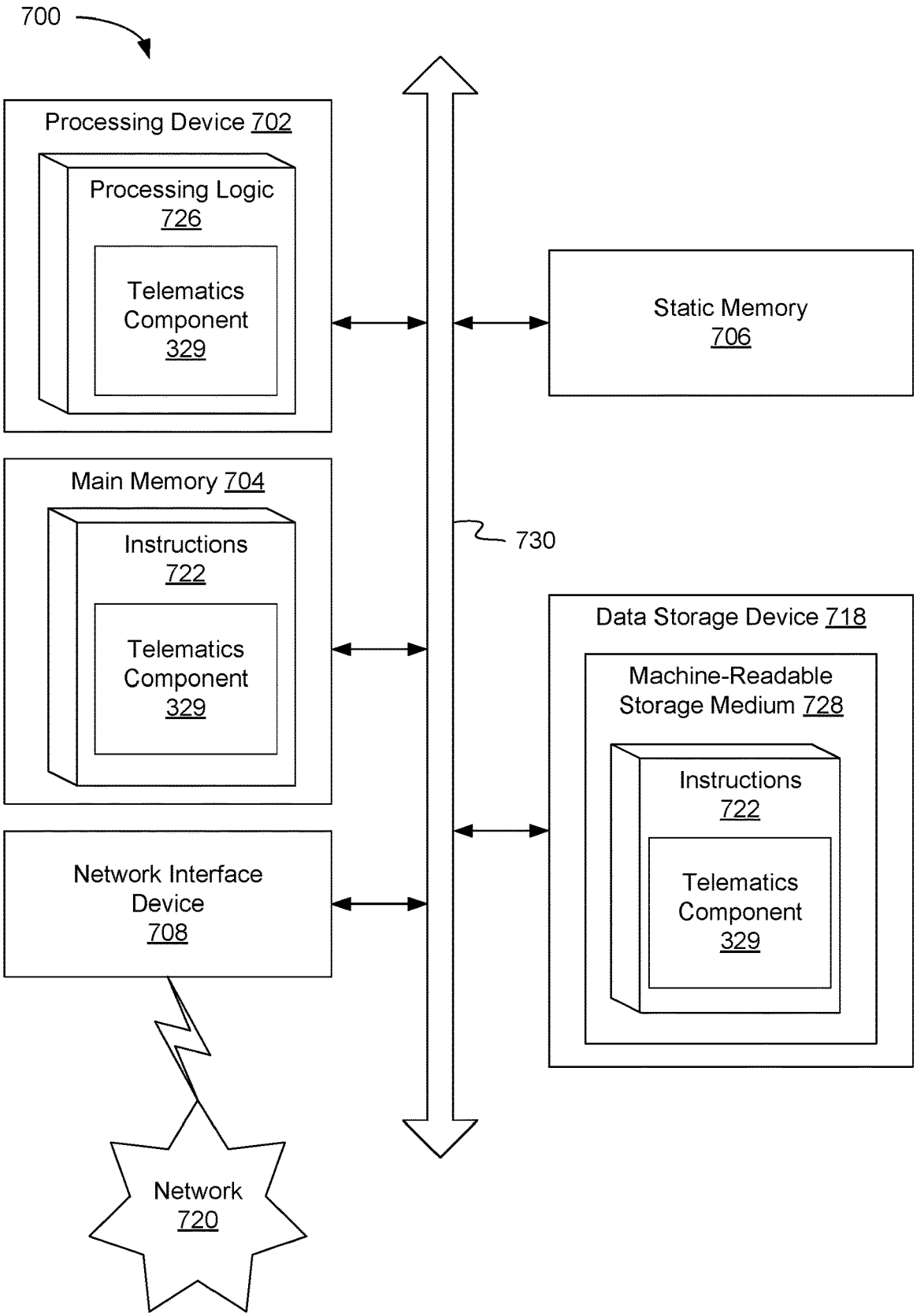
FIG. 7 is a block diagram illustrating an example computer system, in accordance with one embodiment of the present disclosure.

FIG. 7 illustrates a diagrammatic representation of a machine in the example form of a computer system 700 within which a set of instructions, for causing the machine to perform any one or more of the methodologies discussed herein, may be executed. In alternative embodiments, the machine may be connected (e.g., networked) to other machines in a local area network (LAN), an intranet, an extranet, or the Internet. The machine may operate in the capacity of a server or a client machine in a client-server network environment, or as a peer machine in a peer-to-peer (or distributed) network environment. The machine may be a personal computer (PC), a tablet PC, a web appliance, a server, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein. In one embodiment, computer system 700 may be representative of a server configured to control the operations of rotary vacuum drum drying system 100.

The exemplary computer system 700 includes a processing device 702, a user interface display 713, a main memory 704 (e.g., read-only memory (ROM), flash memory, dynamic random access memory (DRAM), a static memory 706 (e.g., flash memory, static random access memory (SRAM), etc.), and a data storage device 718, which communicate with each other via a bus 730. Any of the signals provided over various buses described herein may be time multiplexed with other signals and provided over one or more common buses. Additionally, the interconnection between circuit components or blocks may be shown as buses or as single signal lines. Each of the buses may alternatively be one or more single signal lines and each of the single signal lines may alternatively be buses.

Processing device 702 represents one or more general-purpose processing devices such as a microprocessor, central processing unit, or the like. More particularly, the processing device may be complex instruction set computing (CISC) microprocessor, reduced instruction set computer (RISC) microprocessor, very long instruction word (VLIW) microprocessor, or processor implementing other instruction sets, or processors implementing a combination of instruction sets. Processing device 702 may also be one or more special-purpose processing devices such as an application specific integrated circuit (ASIC), a field programmable gate array (FPGA), a digital signal processor (DSP), network processor, or the like. The processing device 702 is configured to execute processing logic 726, which may be one example of systems 100 and 300 shown in FIGS. 1, 2 and 3, for performing the operations and blocks discussed herein.

The data storage device 718 may include a machine-readable storage medium 728, on which is stored one or more set of instructions 722 (e.g., software) embodying any one or more of the methodologies of functions described herein, including instructions to cause the processing device 702 to execute telematics component 329. The instructions 722 may also reside, completely or at least partially, within the main memory 704 or within the processing device 702 during execution thereof by the computer system 700; the main memory 704 and the processing device 702 also constituting machine-readable storage media. The instructions 722 may further be transmitted or received over a network 720 via the network interface device 708.

The machine-readable storage medium 728 may also be used to store instructions to perform a method for device identification, as described herein. While the machine-readable storage medium 728 is shown in an exemplary embodiment to be a single medium, the term "machine-readable storage medium" should be taken to include a single medium or multiple media (e.g., a centralized or distributed database, or associated caches and servers) that store the one or more sets of instructions. A machine-readable medium includes any mechanism for storing information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read-only memory (ROM); random-access memory (RAM); erasable programmable memory (e.g., EPROM and EEPROM); flash memory; or another type of medium suitable for storing electronic instructions.

The preceding description sets forth numerous specific details such as examples of specific systems, components, methods, and so forth, in order to provide a good understanding of several embodiments of the present disclosure. It will be apparent to one skilled in the art, however, that at least some embodiments of the present disclosure may be practiced without these specific details. In other instances, well-known components or methods are not described in detail or are presented in simple block diagram format in order to avoid unnecessarily obscuring the present disclosure. Thus, the specific details set forth are merely exemplary. Particular embodiments may vary from these exemplary details and still be contemplated to be within the scope of the present disclosure.

Reference throughout this specification to "one embodiment" or "an embodiment" means that a particular feature, structure, or characteristic described in connection with the embodiments included in at least one embodiment. Thus, the appearances of the phrase "in one embodiment" or "in an embodiment" in various places throughout this specification are not necessarily all referring to the same embodiment. In addition, the term "or" is intended to mean an inclusive "or" rather than an exclusive "or."

Additionally, some embodiments may be practiced in distributed computing environments where the machine-readable medium is stored on and or executed by more than one computer system. In addition, the information transferred between computer systems may either be pulled or pushed across the communication medium connecting the computer systems.

Embodiments of the claimed subject matter include, but are not limited to, various operations described herein. These operations may be performed by hardware components, software, firmware, or a combination thereof.

Although the operations of the methods herein are shown and described in a particular order, the order of the operations of each method may be altered so that certain operations may be performed in an inverse order or so that certain operation may be performed, at least in part, concurrently with other operations. In another embodiment, instructions or sub-operations of distinct operations may be in an intermittent or alternating manner.

The above description of illustrated implementations of the invention, including what is described in the Abstract, is not intended to be exhaustive or to limit the invention to the precise forms disclosed. While specific implementations of, and examples for, the invention are described herein for illustrative purposes, various equivalent modifications are possible within the scope of the invention, as those skilled in the relevant art will recognize. The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "one embodiment" or "an implementation" or "one implementation" throughout is not intended to mean the same embodiment or implementation unless described as such. Furthermore, the terms "first," "second," "third," "fourth," etc. as used herein are meant as labels to distinguish among different elements and may not necessarily have an ordinal meaning according to their numerical designation.

What is claimed is:

1. A rotary vacuum drum drying system comprising:

a plurality of sensors; and a control system operatively coupled with the plurality of sensors, the control system comprising a processing device to:

receive, from the plurality of sensors, a plurality of parameters of the rotary vacuum drum drying system;

transmit, to a client device, the plurality of parameters of the rotary vacuum drum drying system;

receive, from the client device, a message comprising an adjustment one or more parameters of the plurality of parameters; and adjust the one or more parameters of the plurality of parameters based on the received message; and a rotatable vacuum drum having a central duct, wherein the plurality of sensors comprises a vacuum pressure sensor operatively coupled in the central duct to monitor vacuum pressure within the rotatable vacuum drum, and wherein the processing device is to adjust vacuum pressure based on the received message from the client device.

2. The rotary vacuum drum drying system of claim 1, wherein the rotatable drum has an outer surface to transport solid product and wherein the system further comprising:

a blade operatively coupled with the outer surface of the rotatable drum to transport the solid product away from the rotatable drum, wherein the plurality of sensors comprises a sensor to monitor mass of a removed filter agent, and wherein the processing device is to adjust a blade position based on the received message from the client device.

3. The rotary vacuum drum drying system of claim 1, further comprising:

a liquid storage tank coupled with the rotatable drum, wherein the plurality of sensors comprises a flow sensor to monitor an outflow rate of liquid from the liquid storage tank, and wherein the processing device is to adjust the outflow rate of liquid based on the received message from the client device.

4. A rotary vacuum drum drying system comprising:

a plurality of sensors; and a control system operatively coupled with the plurality of sensors, the control system comprising a processing device to:

receive, from the plurality of sensors, a plurality of parameters of the rotary vacuum drum drying system;

transmit, to a client device, the plurality of parameters of the rotary vacuum drum drying system;

receive, from the client device, a message comprising an adjustment one or more parameters of the plurality of parameters;

adjust the one or more parameters of the plurality of parameters based on the received message; and a rotatable drum having a central duct, wherein the plurality of sensors comprises a sensor operatively coupled in the central duct to monitor a speed of rotation of the rotatable drum, and wherein the processing device is to adjust the speed of rotation based on the received message from the client device.

* * * * *